US007909293B2

(12) United States Patent
Pease

(10) Patent No.: US 7,909,293 B2
(45) Date of Patent: Mar. 22, 2011

(54) LOW PROFILE DERAIL

(75) Inventor: Ronald G. Pease, Hickory Hills, IL (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 0 days.

(21) Appl. No.: 12/546,868

(22) Filed: Aug. 25, 2009

(65) Prior Publication Data

US 2010/0051757 A1 Mar. 4, 2010

Related U.S. Application Data

(60) Provisional application No. 61/091,839, filed on Aug. 26, 2008.

(51) Int. Cl.
*B61L 19/02* (2006.01)

(52) U.S. Cl. ..... 246/163; 104/261

(58) Field of Classification Search ..... 246/163; 104/261

See application file for complete search history.

(56) References Cited

U.S. PATENT DOCUMENTS

| | | | | |
|---|---|---|---|---|
| 1,464,606 | A * | 8/1923 | Hayes | 246/163 |
| 1,464,607 | A * | 8/1923 | Hayes | 246/163 |
| 1,627,092 | A * | 5/1927 | Hayes | 246/163 |
| 2,829,246 | A * | 4/1958 | Hayes | 246/163 |
| 4,165,060 | A * | 8/1979 | Meyer | 246/163 |
| 6,105,906 | A * | 8/2000 | Pease et al. | 246/163 |
| 6,178,893 | B1 * | 1/2001 | Pease | 104/261 |
| 6,202,564 | B1 * | 3/2001 | Hart et al. | 104/261 |
| 7,549,611 | B2 * | 6/2009 | Hertel | 246/163 |
| 2008/0023592 | A1 * | 1/2008 | Hertel | 246/163 |
| 2010/0051757 | A1 * | 3/2010 | Pease | 246/163 |

* cited by examiner

*Primary Examiner* — S. Joseph Morano
*Assistant Examiner* — Jason C Smith
(74) *Attorney, Agent, or Firm* — Banner & Witcoff, Ltd.

(57) ABSTRACT

This invention relates to a derail assembly used in the railroad industry for derailing the wheel of an undesirably moving railed vehicle and, in particular, relates to derailing a moving locomotive having a pilot at the front of the locomotive. The derail assembly includes a full rigid derail plate which is in direct contact with the entire upper surface of the rail. An upright derail bar is securely mounted on the derail plate and the derail bar is angled outwardly for engaging a wheel of the locomotive when moving undesirably for causing a desired derailment. The derail includes longitudinally spaced rigid hooks at opposite ends of the derail. The hooks secure one side of the derail assembly to the rail. On the opposite side of the rail, a clamp assembly is provided on the derail shoe from the hooks. The hooks and the clamp cooperate to secure the derail assembly to the rail. The derail has an overall height which is less than three inches measured from the upper surface of the rail to the highest point of the derail assembly so a clearance is always provided between the pilot of the moving locomotive and the highest point of the derail assembly.

5 Claims, 5 Drawing Sheets

FIG.1
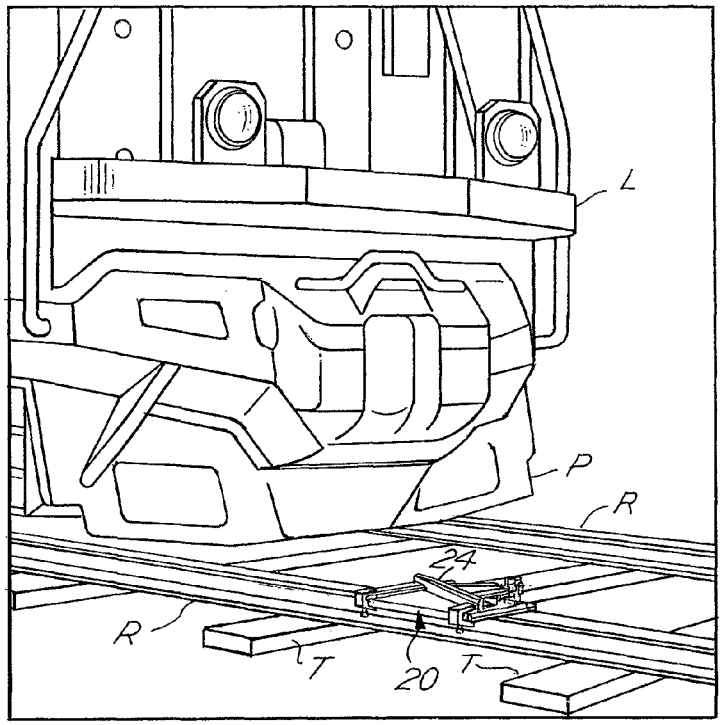
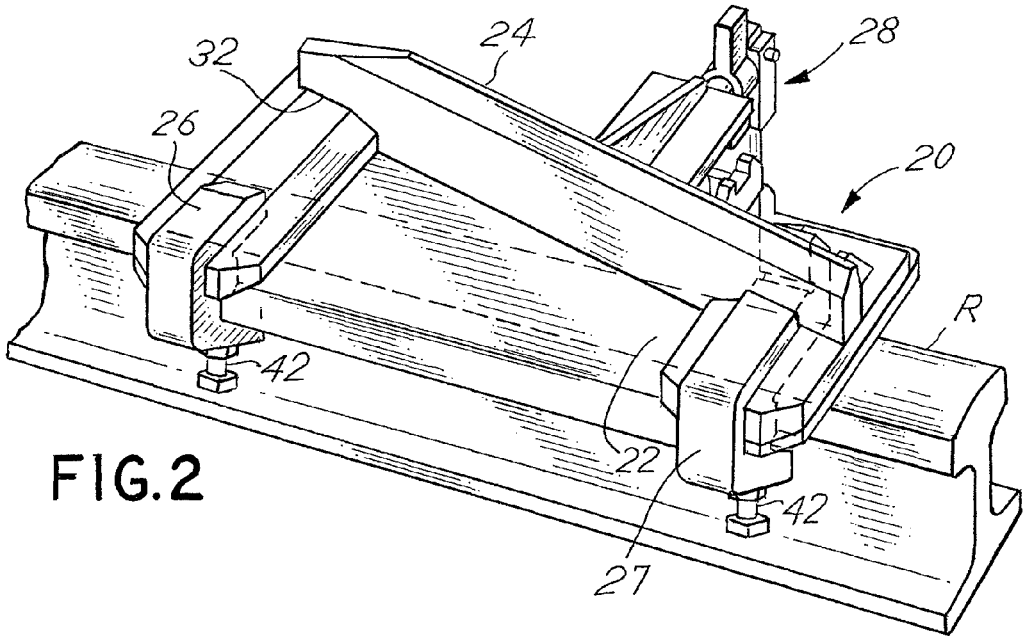
FIG.2

LOW PROFILE DERAIL

CROSS REFERENCE TO RELATED APPLICATION

This is a utility application derived from provisional application Ser. No. 61/091,839 filed Aug. 26, 2008 entitled "Low Profile Derail" which is incorporated herewith and for which priority is claimed.

BACKGROUND OF THE INVENTION

This invention relates to railway safety equipment, namely, derails which are commonly used for derailing railed vehicles including locomotives, railroad cars and the like, which may be undesirably moving along railroad tracks, normally at a relatively low speed. There are many types of derails, known in the rail industry, which have been used for many years. Certain types of derails are substantially permanently fixed to one rail of a pair of railroad track rails and various methods may be used to move the derail between an operative position and an inoperative position. Some derails are relatively light in weight so as to be portable and are not movable between operative and inoperative positions.

At least in connection with certain types of derails, the railway industry historically required that the highest point of a derail was not to be higher than four inches measured from the top of the rail upon which the derail was affixed. A principal reason for this requirement was that the pilot (sometimes called a "cowcatcher") of a railway locomotive must be allowed to clear the highest point of the derail so that a heavy locomotive's pilot did not sweep, push or knock off the entire derail when the locomotive was undesirably moving at a relatively low speed, such as up to 10 miles per hour. If the derail is moved out of derailing position by the pilot, the derail becomes ineffective and the undesirably moving locomotive may cause serious damage to other locomotives or railway cars, such as at a railroad yard, or even cause serious injury or death to railway workers in the area.

Relatively recently, the railway industry changed its standards to require that certain derails could not have its highest point more than three inches above the upper surface of a railroad rail upon which the derail is affixed. In essence, certain existing derails higher than or just at three inches above the rail could be unsafe to use, particularly in connection with undesirably moving heavy locomotives, because the entire derail could be forced off the track by the pilot of the locomotive before the lead wheel of the undesirably moving locomotive could be engaged by the derail, thereby causing the undesirably moving locomotive to continue moving unsafely rather than allowing the derail to remain in place and cause a safe derailment of the locomotive if needed.

SUMMARY OF THE INVENTION

The subject of this invention is a redesign of the derails as disclosed in U.S. Pat. No. 4,165,060 and particularly in U.S. Pat. No. 6,105,906, the disclosures of which are incorporated herein by reference. More specifically, the invention herein is a redesign and an improvement over the embodiment of FIGS. 10-13 of the '906 patent and is designed to assure that the pilot (cow catcher) of an undesirably moving locomotive does not move, such as by forcing or pushing, the derail off the rail so the derail is effective in causing a safe derailment.

The present invention is directed to a low profile, portable derail, such as shown in the above-mentioned patents (particularly the embodiment of FIGS. 10-13 of the '906 patent) and which is particularly designed to have a height of less than three inches, preferably at least 2¾", from the highest point of the derail down to the upper surface of the track upon which the derail is mounted. Preferably, a clearance of at least ¼" is provided by the maximum height of the derail between the lowest point of the locomotive pilot and the derail. Since the derail is designed to derail a moving locomotive having a pilot at the lower front-end thereof, the derail must have high strength capacity to effectively derail the undesirably moving very heavy locomotive(s) which could move at speeds as high as 10 miles per hour. Since the pilot of the locomotive may be as low as three inches above the rail upon which it is moving, the design of the derail herein cannot be pushed or forced off the rail by the pilot of the locomotive before the lead wheel approaches the derail. The derail of the present invention, although being particularly effective to derail locomotives, will also be effective in derailing undesirably moving railway cars.

In actual testing, two locomotives were ganged or attached together and were caused to move at speeds up to 10 miles per hour. In this test, one embodiment of the present invention was effective in derailing the locomotive. However, the initial testing, although effective, resulted in an improved redesign of the derail that was first tested. Apparent potential problem areas of the tested design were found. Improvements were made in a second and later preferred embodiment of the invention.

There is a need in the railroad industry to provide a derail, preferably relatively light in weight, to be portable and yet be effective to derail an undesirably moving locomotive, having a weight of approximately 350,000 pounds or even two such locomotives, at about 950,000 pounds connected together, wherein the locomotive's pilot will clear the derail of the present invention used on the track without the derail being forced off by the pilot of the locomotive before the lead wheel reaches the derail. The derail must be less than three inches in height above the upper surface of the track, preferably providing a ¼" clearance between the pilot and the derail, and yet be strong and sturdy enough to effectively derail 350,000 pounds of one locomotive or, possibly, even two connected locomotives moving at speeds up to 10 miles per hour.

The above-mentioned need for a portable derail sufficiently strong to derail one or two locomotives at speeds up to 10 miles per hour is accomplished by an improved derail design. The low profile derail (less than three inches in overall height clearance from the top of the rail) includes an elongated derail shoe in direct contact with and completely covering the entire length of substantially the entire upper surface area portion of the one rail upon which the derail is mounted. The elongated derail shoe has a wheel entrance end and a wheel exit end. An upright derail bar is securely mounted on the derail shoe and is angled outwardly, that is, towards the field side of the rail from the wheel entrance end to the wheel exit end of the elongated derail shoe which rests upon the one rail. The derail assembly further includes at least two longitudinally spaced one-piece rigid hooks which are fixedly secured to the derail shoe one side thereof at the wheel entrance end and at the wheel exit end. Securing members, such as screws, are operatively mounted on the hooks for selectively securing the derail assembly on the outer side of one side of the one rail. A clamp assembly is secured to the derail shoe on the opposite side of the derail shoe from the hooks. The hooks, the securing members and the clamp assembly cooperate to secure the entire derail assembly to the one track. Preferably, a reinforcing portion is provided on the exit hook for reinforcing the critical exit end of the derail bar for assuring successful derailing of the lead wheel of the moving locomotive or other moving railroad car.

BRIEF DESCRIPTION OF THE DRAWINGS

The accompanying drawings are incorporated into and are a part of the description of the invention. The drawings illustrate certain embodiments of the present invention and serve to explain and describe embodiments of the invention. The drawings are not to be construed as limiting the scope of the invention, but are intended to assist in the description of the invention.

Referring to the drawings:

FIG. 1 is an illustration showing the front of a locomotive with a pilot located in the front lower portion thereof and showing a derail assembly affixed to one rail of a pair of railroad tracks upon which the locomotive is moving;

FIG. 2 is a perspective view showing one embodiment of the derail assembly of the present invention mounted on the one rail illustrated in FIG. 1;

DESCRIPTION OF EMBODIMENTS OF THE INVENTION

Figure 3:
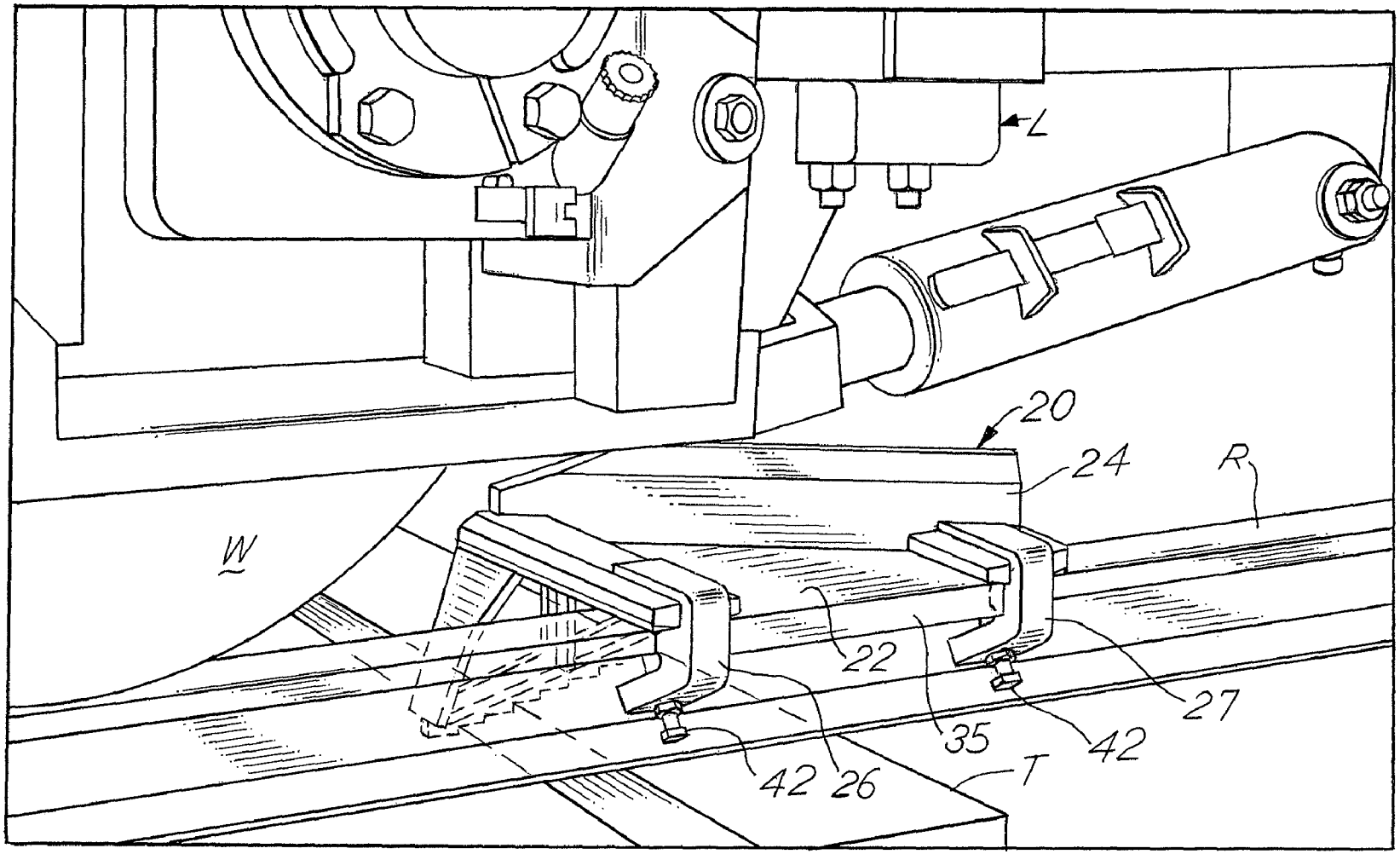
FIG. 3 is an illustration of a portion of the wheel assembly of the locomotive of FIG. 1 showing a front wheel approaching the derail assembly of the present invention.

Referring to FIGS. 1-3 of the attached drawings, the manner of using the derail assembly, general 20, is shown. Referring to FIG. 1, the front of a locomotive L is shown as it moves along a pair of conventional spaced steel railroad track rails R which are fixedly supported in a conventional manner upon conventional railroad ties T. The ties T are mounted transverse to the elongated rails R upon which the locomotive L is moving. The front lower portion of the locomotive L is shown having a pilot P (historically formerly known as a cowcatcher). Under relatively new railroad industry specifications, the lowest point of the pilot P may now having a clearance of only 3" above the top of the rail R. If the locomotive L is moving undesirably at speeds above 5 MPH, and up to 10 MPH, the derail 20, as shown in FIG. 1, must be lower in height, such as 2¾" to preferably give at least ¼" clearance below the lowest point of the pilot P to the highest point of the derail 20. Otherwise the pilot P could simply push or force the derail assembly 20 off the rail R upon which derail 20 is affixed. If this occurs, the derail 20 would be useless in effecting a desired derailment of an undesirably moving locomotive L.

Again, referring to FIG. 1, the derail assembly 20 is shown mounted on the rail R. The derail 20 is positioned in such a manner as to cause a derailment of the undesirably moving locomotive L to the right side of the moving locomotive L for derailment to the field side of the spaced rails R. (The space between the rails R is known as the gage side.)

Referring to FIG. 2, the derail assembly 20 is shown mounted upon a rail R. The derail assembly 20 includes a steel, rigid derail shoe plate 22 which is mounted directly upon and rests upon and substantially completely covers the entire upper surface portion of the rail R to which the derail assembly 20 is attached. A wheel deflecting bar 24 is rigidly fixed in a substantially upright position, preferably vertical, on the upper surface of the derail shoe plate 22. The bar 24 is mounted at an angle effective to engage the wheel W, as shown in FIG. 3, which is the lead wheel W of the moving locomotive L. The deflecting 24 is angled outwardly from the entrance end to the exit end of the derail 20 at between 11-28 degrees.

The derail assembly 20 further includes an entrance derail hook 26 and an exit derail hook 27. The derail hooks 26 and 27 are rigidly secured to the derail shoe plate 22 and are spaced at opposite ends of the plate 22. The hooks 26 and 27 are provided so as to secure one side of the derail assembly 20 to the field or outer side of the rail R. Again referring to FIG. 2, the derail assembly 20 further includes an adjustable clamp assembly 28 that is operatively secured to the plate 22 and is designed to secure the opposite side or gage side of the derail assembly 20 to the rail R.

Figure 5:
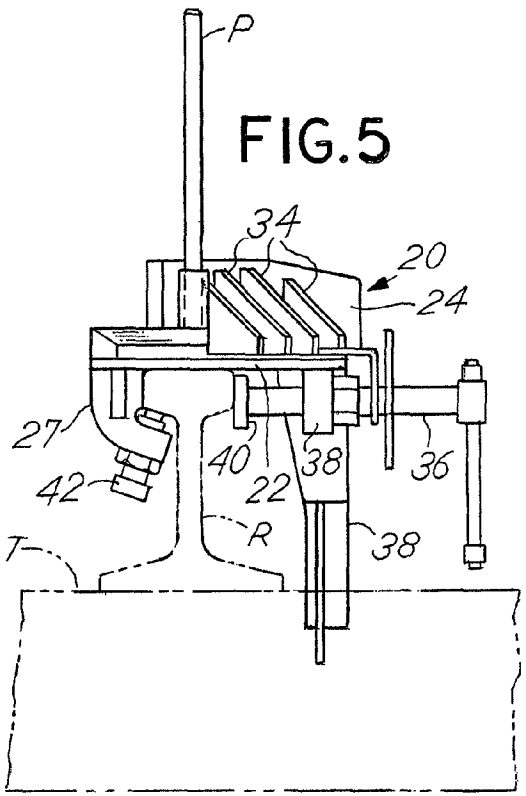
FIG. 5 is an end elevational view of the derail assembly of FIG. 4.
Figure 6:
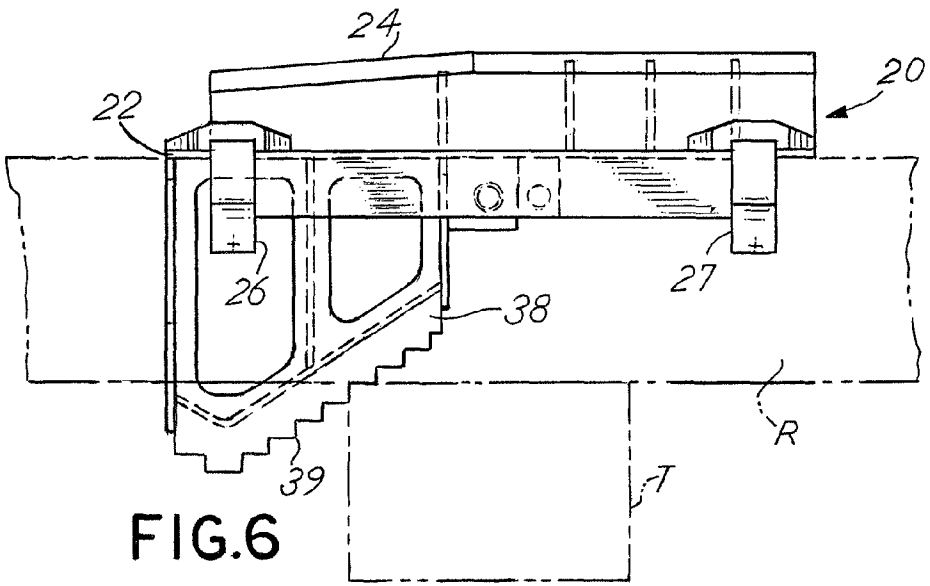
FIG. 6 is a side elevational view of the derail assembly of FIGS. 4 and 5.

Although not shown in FIGS. 1-2, a rigid upright bracing assembly, generally 38, is shown in FIGS. 3, 5 and 6, is mounted on the underside of the shoe plate 22 of the derail assembly 20 and is designed to vertically support the derail assembly 20 as the heavy load of the front wheel W of the moving locomotive L comes into forcible contact with the assembly 20, and specifically the deflecting bar 24.

Referring to FIG. 3, the lead wheel W of the moving locomotive L, which may be moving undesirably at speeds of up to 10 miles per hour, is effectively derailed by the derail assembly 20 since the pilot P, which may be as low as 3" above the upper surface of the rail, has cleared the derail assembly 20 which is less than 3" above the upper surface of the rail R, preferably 2¾" above the rail R, to provide a clearance of at least ¼".

Figure 4:
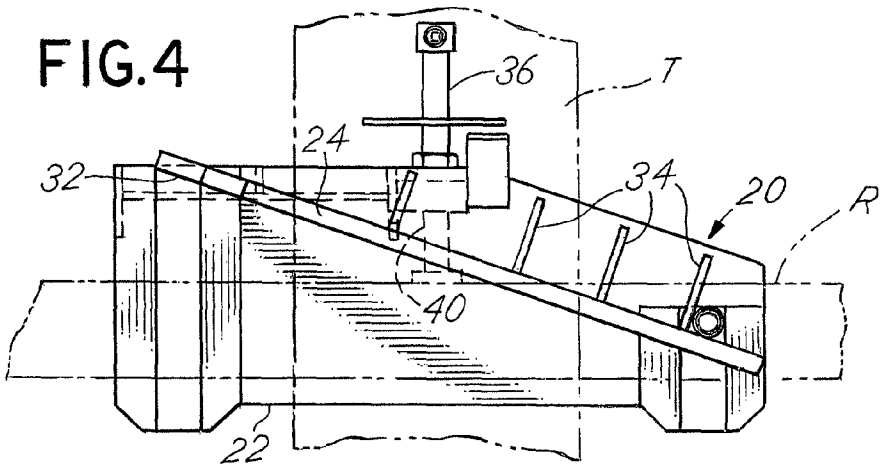
FIG. 4 is a top plan view of the derail assembly of FIGS. 1-3 with a rail shown in hidden view lines.

First Derail—FIGS. 4-6

Referring to FIGS. 4-6, the derail embodiment 20 is shown in somewhat greater detail. Some common details are found in U.S. Pat. No. 6,105,906, which is incorporated herein by reference. As previously indicated, the upright deflecting bar 24 is effectively angled outwardly to engage the moving lead wheel W of the locomotive L since the pilot P of the locomotive L has cleared the highest point of the derail assembly 20, thereby derailing the moving locomotive L to the field side of the rail R.

Referring to FIGS. 4-6. the entrance derail hook 26 is rigidly secured to the derail shoe plate 22, as by welding, along its lower surface while the inner end or gage side end 32 of the entrance derail hook 26 is welded to the outer or field side face of the entrance end of the deflecting bar 24.

The derail shoe 22 is a rigid heavy duty plate that is welded to the lower edge of the upright deflecting bar 24 along the entire length of the bar 24 along the field side face of the deflecting bar 24. The field side of the derail shoe plate 22 has a unitary, upright, downwardly extending flange 35 that covers the outer edge of the upper flange of rail R, as best seen in FIG. 2. The flange 35 as seen best in FIG. 2, and the substantially complete coverage of the adjacent upper surface portion of the rail R by the derail shoe on plate 22 provides significantly greater strength to the derail plate 22 to thereby significantly strengthen the entire derail 20. The plate 22 and flange 35 are stronger than the ultralight embodiment of FIGS. 10-13 of the '906 patent and such a design feature is important to derail an undesirably moving locomotive L. As seen best in FIG. 4, towards the exit end of the upright deflecting bar 24, upright support plates 34 are rigidly positioned against the upright of the derail bar 24. These upright plates 34 are also welded along the lower edges thereof to the derail shoe plate 22 while their upright edges are welded to the inner side or gage side face of the deflecting bar 24 to provide added strength to the deflecting bar 24 as the wheel W has been engaged by the bar 24 and cause the controlled derailment.

Referring to FIG. 5, the derail assembly 20 is shown resting upon a rail R. A clamp assembly 36 is securely and operatively carried by a support assembly 38. The clamp 36 includes an upright end plate 40 which is designed to bear against the outer upright face of the upper flange of the rail R. The clamp 36 on the gage side of the rail R and the longitudinally spaced screw hook blocks 26 and 27, on the field side, cooperate to secure the derail 20 to the rail R. Although two hook blocks 26 and 27 are shown in the drawing, for further strengthening, one or more additional hook blocks could be provided.

Referring again to FIGS. 4-6, the hook block assembly 26 and the hook block assembly 27 each have an inwardly and downwardly angled portion that threadably receives a screw 42 that is designed to be rotated generally upwardly to bear against the lower surface of the upper flange of the rail R. In assembling the derail assembly 22 to the rail R, it is preferred that the screws 42 in the hook blocks 26 and 27 first be adjusted to bear against the lower surface of the upper flange of the rail R and then the clamp 36 is adjusted to cause the end plate 40 to bear firmly against the upright outer surface of the upper flange of the rail R. The screws 42 are then firmly tightened the rail R. In FIG. 5, there is shown an upright pole P for a warning flag (not shown) that is merely an identifying signal that lets workers know that the derail 20 is in place. The pole P and flag assembly have no operative function relative to the invention described herein.

The upright rigid support assembly 38 is rigidly secured to the underside of the derail shoe plate 22 on the gage side of the derail assembly 20 as seen best in FIG. 5. The lower surface of the upwardly angled support 38 has teeth 39 that are designed to bear against the upper side corner of a transverse railroad tie T so as to enable the outer portion of the derail assembly 20 to be vertically supported by the support 38 during derailment of a locomotive L. Multiple teeth 39 are provided so that the derail plate 22 can be adjusted to a selected position to rest against the upper surface of the upper flange of the rail R.

The derail assembly 20 differs from U.S. Pat. No. 6,105,906 primarily in the fact that the derail shoe plate 22 is not only adjacent the surface of the rail flange but it covers substantially the entire upper surface area of the rail R. The unitary flange 35 portion of the plate 22 provides significant further strength. Upright supports 34 are provided on the gage side of the deflecting bar 24 to further strengthen the assembly 20. The weight of a tested derail 20 was about 35 pounds while the weight of the "ultralight" derail of the '906 patent was about 28 pounds. In other words, the plate 22 is continuous and rigid and does not include a cut-out portion as shown in FIG. 13 of the '906 patent. In testing, it was found that the derail 20, as shown and discussed above, did provide enough strength to cause a derailment during an actual test. Certain weaknesses in the test derail resulted in further improvements to be discussed relative to the derail, general 48, shown in FIGS. 7-11.

Strengthened Derail Embodied in FIGS. 7-11

The improved derail embodiment 48 is shown in FIGS. 7-11 which includes a derail shoe plate 50 which, like the derail plate 22 of the derail 20, substantially covers the entire upper surface area of the rail R upon which the assembly 50 is secured. The plate 50 includes a unitary downturned flange 51. The heavy duty derail shoe plate 50 and flange 51 provide significant stability and rigidity to the assembly 48 to better resist torquing resulting from the heavy weight of the front end of an undesirably moving locomotive L during a controlled derailment.

A deflecting bar 52 is rigidly secured as by welding to the upper surface of the derail shoe 50 and is angled outwardly, that is, from the gage side, toward the field side of the rail R. The mounting of the derail assembly 48 upon the rail R is substantially the same as the mounting of the derail assembly 20 upon the rail R, as discussed in FIGS. 1-6.

Upright support plates 60 are secured by welding to the upper surface of the plate 50 and to the inner upright surface of the deflecting bar 52 in order to support the inner side or gage side of the deflecting bar 52. The deflecting bar support plates 60 are preferably about ⅜" thick as opposed to the 3/16" thickness of the supports 34 of the derail 20. A clamp assembly 62 is located on the field side of the assembly 62 and is securely attached to the derail shoe plate 50. The clamp assembly 62 is supported on the derail assembly 48 in substantially the same manner as with the derail embodiment 20 of FIGS. 4-6. The clamp assembly 62 includes an end plate (not shown), which bears against the outer upright face of the upper flange of the rail R as like the derail embodiment 20 of FIGS. 4-6.

Like the embodiment 20 of FIGS. 4-6, the derail assembly 48 also includes an entrance derail hook 54 and an exit derail hook 56. Each hook 54 or 56 is rigidly secured, as by welding, to the upper surface of the derail shoe 50. An upright bracing assembly 58, is designed to be positioned on the gage side of the derail assembly 20. The bracing assembly 58 is rigidly constructed in order to better support the heavy weight of a moving locomotive L as it is being derailed. More specifically, the bracing assembly 58 of the embodiment 48 is doubled in thickness from the bracing assembly 20, that is, the brace is ⅜" thick versus the 3/16" thickness of the brace 38 of the first derail assembly 20.

Figure 9:
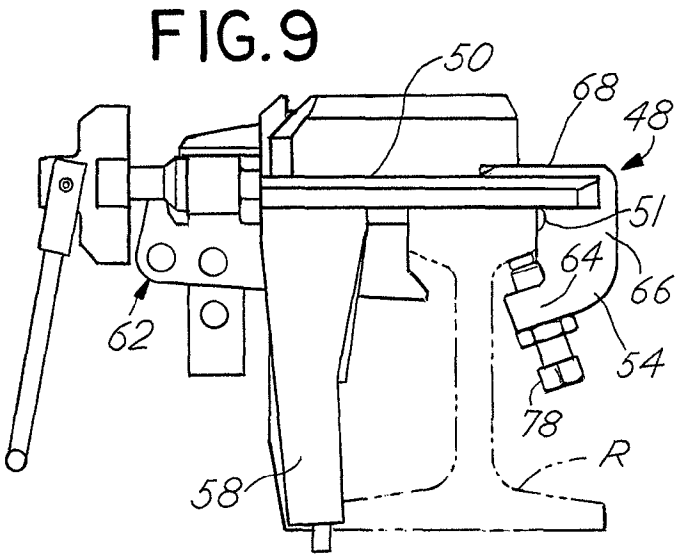
FIG. 9 is an end elevational view of the embodiment of the derail assembly illustrated in FIGS. 7 and 8.
Figure 7:
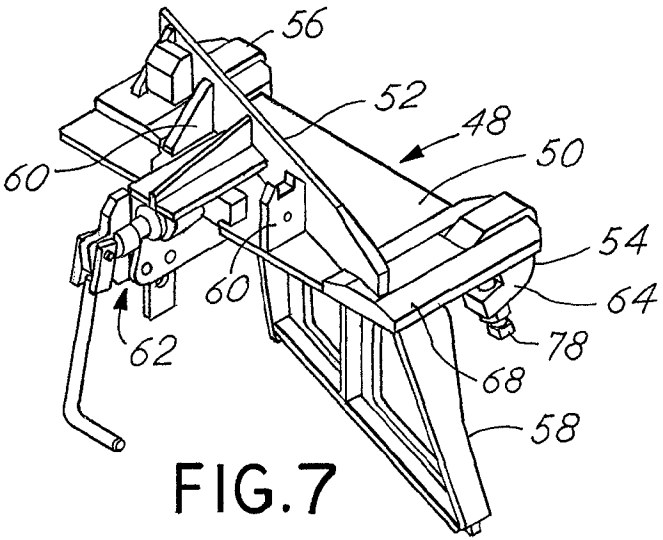
FIG. 7 is a pictorial view of a derail assembly made in accordance with a second embodiment of the present invention.
Figure 8:
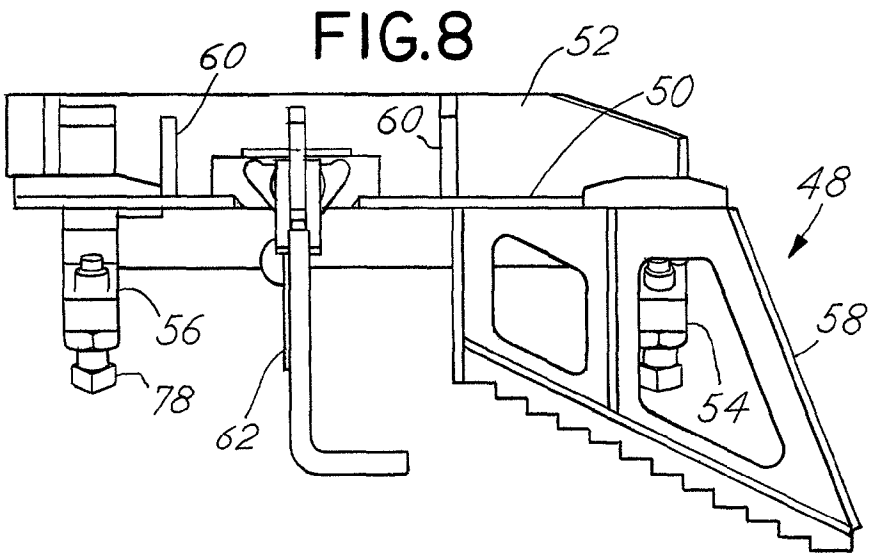
FIG. 8 is a side elevational view of the derail assembly embodiment of FIG. 7 of the present invention.

A further difference between the derail embodiment 20 of FIGS. 4-6 and the derail embodiment 48 of FIGS. 7-9 is found in the design of both the entrance hook 54 and the exit hook 56. Referring to FIGS. 7 and 9, the entrance end hook 54 includes an inwardly facing slightly downwardly angled portion 64, a unitary upright outer portion 66, and an inwardly directed or gage directed unitary upper portion 68, which is directed straight inwardly. The upper portion 68, for substantially its entire length, is secured to the upper surface of the derail shoe 52 such as by welding. In contrast to the embodiment 20 of FIGS. 4-6, the embodiment of FIG. 7 provides a stronger interconnection between the deflecting bar 52 and the upper portion 68 of the entrance hook 54. As seen in FIG. 7, the upper portion 68 passes beneath a cut-out portion of the entrance end of the deflecting bar 52 and passes externally beyond the inner surface of the upright deflecting bar 52. The entrance hook 54 is welded along and to the front surface of the deflecting bar 52, and is also welded along the rear surface of the deflecting bar 52 at the outer portion of the bar 52.

Figure 10:
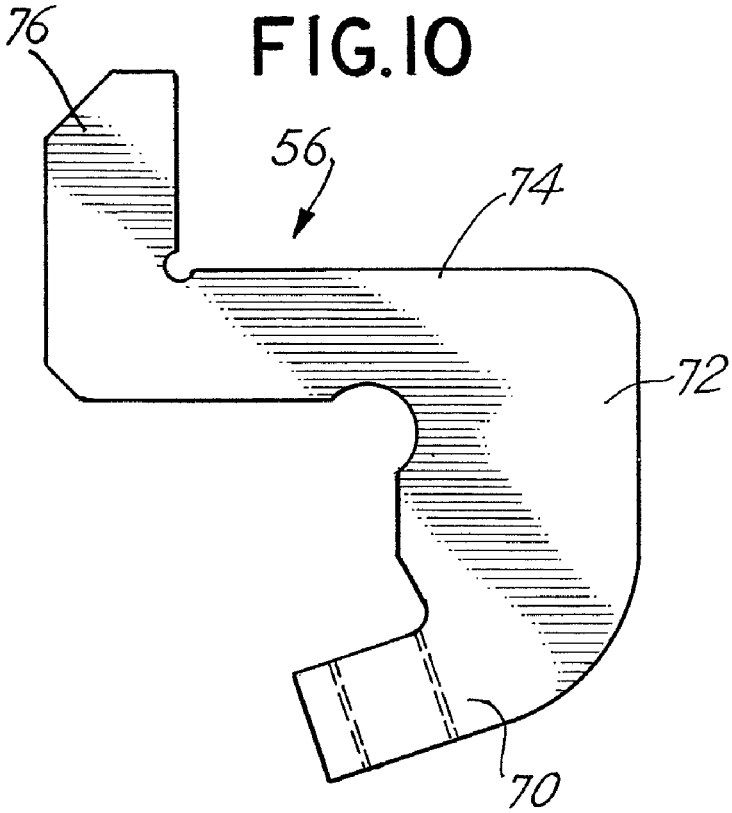
FIG. 10 is a detail side view of the exit and of one screw hook used in the derail assembly embodied in FIGS. 7-9.
Figure 11:
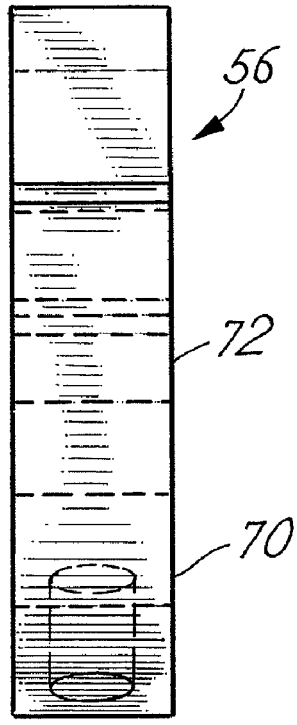
FIG. 11 is an end elevational view of the screw hook of FIG. 10.

Referring to FIGS. 7, 10 and 11, the exit hook 56 includes a lower, inwardly and downwardly angled portion 70, a unitary upright portion 72, and a substantially horizontal inwardly directed unitary upper portion 74. In contrast to the entrance hook 54, the exit hook 56 includes a unitary upwardly directed upright portion 76. The exit hook 56 generally has an S-shape. The upright portion 76 provides greater rigidity for the exit hook 56 by supporting the exit end of the deflecting bar 52 to better assure derailment of a moving locomotive. The upright portion 76 is welded to the inner face of the deflecting bar 52 to provide added rigidity to the exit hook 56. Particularly in the case of a heavy locomotive, the exit end of the derail 48 must be exceptionally strong to assure effective derailing of a locomotive L to the field side of the rail R when the wheel W engages the derail 48. In effect, the exit end of the derail assembly 48 takes the highest level of weight or force from the wheel W of the heavy, moving locomotive L during a derailment.

The derail assembly 48 of FIGS. 7-11 is secured to a rail R in substantially the same manner as previously described. First, the screws 78 carried by the entrance hook 54 and exit hook 56 are rotated upwardly so that the upper ends of the screws 78 bear against the lower flange of the rail R to secure one side of the derail 48 to the rail R. The clamp assembly 62 is then adjusted by rotation to cause the end plate (not shown in FIG. 7) to bear against the outward upper surface of the upper flange of the rail R as seen best in FIG. 5 on the opposite side of the rail R from the hooks 54 and 56. The screws 78 are then tightened against the rail R. The clamp assembly 62 and the hooks 54 all cooperate to securely hold the derail 48 in place as a moving locomotive L is being derailed by the derail assembly 48.

The derail 48 of FIGS. 7-11 is generally more robust in design than the derail 20, as described above. The overall weight of the derail 48 is about 42 pounds versus the 35 pounds of the derail 20, and the 28 pounds of the ultralight derail of the '906 patent. This generally robust design of the derail 20 thereby provides greater assurance that the desired derailing of an undesirably moving locomotive L or two ganged locomotives L will be accomplished.

While in the foregoing, there has been provided a detailed description of embodiments of the present invention, it should be recognized to those skilled in the art that the described embodiments may be altered or amended without departing from the spirit or scope of the invention defined in the accompanying claims.

What is claimed is:

1. A low profile derail assembly for derailing a wheel of a lead wheel of a moving railway vehicle when said railway vehicle is undesirably moving along a pair of laterally spaced rails, railroad ties being securely and transversely mounted to and between said rails, each of said rails having an upper surface, an outer side and an inner side, said derail assembly being secured to a portion of one of said rails, said derail assembly comprising:

an elongated rigid derail plate being in direct contact with substantially the entire upper surface portion of said one rail upon which said derail assembly is secured, said elongated derail plate having a wheel entrance end and a wheel exit end longitudinally spaced from said wheel entrance end, an upright rigid derail bar being rigidly secured to said derail plate, said upright derail bar being angled outwardly from said wheel entrance end to said wheel exit end for engaging a wheel of said undesirably moving vehicle to thereby cause a desired safe derailment of said undesirably moving vehicle, at least two longitudinally spaced unitary rigid hooks fixedly secured to said derail plate at said wheel entrance end and at said wheel exit end, each of said hooks including means operably mounted on said hooks for securing said derail assembly along one side of said rails, said entrance end hook having a lower inwardly directed portion extending toward said rail, a screw being received in said lower portion of said entrance end hook for bearing against said rail, a unitary upright outer portion, and a unitary upper inwardly directed portion extending inwardly toward said upright derail bar and passing beyond and below said upright derail bar, said inwardly directed portion of said hook being rigidly connected to said derail plate and to said derail bar, said exit end hook having a lower, inwardly directed portion toward said rail, a screw being received in said lower portion of said exit end hook for bearing against said rail, a unitary upright outer portion, a unitary upper inwardly directed portion extending toward and below said derail bar, and a unitary upright inner portion bearing against the inner side of said derail bar, said upright portion being rigidly secured to the inner side of said derail bar at said exit end, and a clamp assembly secured to said derail plate on the opposite side of said derail plate from said hooks, said clamp assembly including means for releasably securing said derail assembly to said one rail opposite said hooks, said hooks and said clamp assembly cooperating to secure said derail assembly to said rail on the opposite side of said rail from said hooks.

2. The derail assembly of claim 1 wherein said elongated derail plate includes a unitary flange extending downwardly and positioned against said outer side of said rail.

3. The derail assembly of claim 2 wherein said railway vehicle is a locomotive having a pilot, said pilot having a lowest point at a preselected distance above said upper surface of one of said rails, and said derail assembly having an overall height which is less than the preselected distance between the low point of said pilot and the upper surface of one of said rails thereby assuring that said pilot does not engage said derail assembly when said locomotive is undesirably moving.

4. The low profile derail assembly of claim 3 wherein the preselected distance between the low point of said pilot and the upper surface of one of said rails is about three inches and the preselected distance between the upper surface of one of said rails and the highest point of said derail assembly is about 2¾ inches.

5. The derail assembly of claim 1 including upright support plates secured to the upper surface of said derail plate and to the inner upright surface of said derail bar for providing additional support for said deflecting bar during derailment of said moving vehicle.

* * * * *